US007125341B1

(12) United States Patent
D'Eath

(10) Patent No.: US 7,125,341 B1
(45) Date of Patent: Oct. 24, 2006

(54) GOLF CLUB PUTTER

(75) Inventor: Roger D'Eath, North Port, FL (US)

(73) Assignee: DSP Golf Concepts, Inc., Port Charlotte, FL (US)

( * ) Notice: Subject to any disclaimer, the term of this patent is extended or adjusted under 35 U.S.C. 154(b) by 126 days.

(21) Appl. No.: 10/840,210

(22) Filed: May 4, 2004

(51) Int. Cl.
*A63B 53/02* (2006.01)
*A63B 53/04* (2006.01)
*A63B 53/08* (2006.01)

(52) U.S. Cl. ..... 473/251; 473/313; 473/340; 473/341; 473/349; 473/334

(58) Field of Classification Search ..... 473/334–339, 473/340–341, 251–256, 249, 313, 349
See application file for complete search history.

(56) References Cited

U.S. PATENT DOCUMENTS

| | | | | | |
|---|---|---|---|---|---|
| 1,902,660 | A * | 3/1933 | Nelson | 473/558 |
| 3,995,857 | A | 12/1976 | Cochran et al. | |
| 4,834,387 | A * | 5/1989 | Waites et al. | 473/252 |
| 5,290,035 | A | 3/1994 | Hannon et al. | |
| 5,333,863 | A * | 8/1994 | Shenoha et al. | 473/314 |
| 5,335,913 | A | 8/1994 | White | |
| 5,571,052 | A | 11/1996 | Bolanos | |
| 5,630,765 | A * | 5/1997 | Moore | 473/252 |
| 5,716,290 | A | 2/1998 | Baker et al. | |
| 5,916,035 | A | 6/1999 | Caiozzo | |
| 5,921,871 | A | 7/1999 | Fisher | |
| 5,938,540 | A | 8/1999 | Lu | |
| 5,947,837 | A * | 9/1999 | Perry | 473/313 |
| 6,024,652 | A | 2/2000 | Westbrook | |
| 6,095,931 | A | 8/2000 | Hettinger et al. | |
| 6,257,994 | B1 * | 7/2001 | Antonious | 473/331 |
| 6,383,089 | B1 | 5/2002 | Bonneau | |
| 6,435,979 | B1 * | 8/2002 | Mounfield, Jr. | 473/324 |
| 6,450,894 | B1 * | 9/2002 | Sun et al. | 473/252 |
| 6,478,694 | B1 | 11/2002 | Anderson et al. | |
| 6,679,782 | B1 | 1/2004 | Tang et al. | |
| 6,692,372 | B1 | 2/2004 | Colucci | |
| 2002/0103039 | A1 * | 8/2002 | Shmoldas et al. | 473/251 |

* cited by examiner

*Primary Examiner*—Sebastiano Passaniti
(74) *Attorney, Agent, or Firm*—Charles J. Prescott

(57) ABSTRACT

A golf club putter head including an elongated body formed of a first metal and having an upright front portion defining a ball striking face, enlarged heel and toe portions symmetrically shaped about a vertical central axis of said body, and a horizontal bottom portion defining outer portions of beveled bottom surfaces. The front and bottom portions have a thickness at each central portion thereof which is substantially less than a width and a height, respectively, of the heel and toe portions. A slanted elongated cavity having a longitudinal axis receives and secures a lower distal end of a golf club shaft. A sole plate formed of a second metal is secured within a mating slot formed into only a central portion of the bottom surface. A front edge of the sole plate also forms a lower central portion of the ball striking face while a bottom surface of the sole plate is continuous with the bottom surfaces of the body. A balance weight formed of a third metal denser than that of the first metal is positioned and secured into a mating cavity formed into the bottom surface of the heel portion to cause the putter head to be balanced about the longitudinal axis of the golf club shaft.

11 Claims, 2 Drawing Sheets

GOLF CLUB PUTTER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the field of golf club design and construction, and more particularly to a unique golf club putter head design formed of multiple metals.

2. Description of Related Art

The field of golf has enjoyed perhaps the greatest proliferation of equipment improvements available to its avid participants of any hobby or pastime. The popularity of professional golf has heightened not only participation by tremendously increasing numbers of golfers, but has also consequently spurred the development and introduction of very sophisticated equipment designs and materials.

The golf club putter in general has been the recipient of great inventive effort directed toward the achievement of the ultimate putter design. One such effort is disclosed in U.S. Pat. No. 6,393,089 invented by Bonneau which teaches an inverted mass relieved putter head in the form of a general block of metal having a conventional striking face with mass relieved portions behind the face of the putter head club. A plug of heavy metal is centered at the center of gravity to add stiffness with emphasis on the use of exotic materials for proper head weight.

A customizable golf putter head with a face insert is taught by Anderson in U.S. Pat. No. 6,478,694. The face member has a cavity formed in its rear surface to receive a weighted face insert. In a very recent U.S. Pat. No. 6,679,782, Tang discloses a putter head having a body preferably formed of stainless steel, the body including a face portion, a crown portion, a sole portion and an aft mass portion to achieve novel inertial properties. An alignment means for aiming a golf ball during putting is also provided.

A golf club with interchangeable sole is taught by Lu in U.S. Pat. No. 5,938,540. This allows for customizing the club head with selected ground-engaging sole plates to more closely match ground and grass conditions. An adjustable golf putter is disclosed in U.S. Pat. No. 6,024,652 by Westbrook teaching a novel energy transmitting head composition which transmits vibrational energy upon contact with a golf ball. A unique layered design of high density elastomer, PVDF, carbon fiber, polyester resin and aluminum is disclosed.

Another golf putter head design is disclosed by Caiozzo in U.S. Pat. No. 5,916,035. This golf putter head includes an arcuate cavity extending from the back surface of the hitting face and a semi-circular rear section attached to and extending back from the front section. A keyhole-shaped cutout formed into the semi-circular lip for weight/balance redistribution is also provided. Still another golf putter head is disclosed by Bolanos in U.S. Pat. No. 5,571,052 teaching a club head body having a center of mass, the center of effort located on the striking face in axial alignment with the center of mass to define an axis of effort extending through the club head body.

A balanced putter with top spin facility is disclosed by Baker in U.S. Pat. No. 5,716,290. This club head includes a member securable to the exterior surface of the club head formed of a material different from the material constituting the club head itself, the member having an arcuate configuration for striking the ball.

Hettinger, in U.S. Pat. No. 6,095,931 teaches a bimetallic golf club head having a weighted body for lowering the center of gravity of the club head itself in order to achieve an increase in the vertical gear effect upon impact with a golf ball. In U.S. Pat. No. 5,290,035, a balanced golf club putter taught by Hannon includes two chambers that increase the proportion of heel and toe mass relative to the center mass and decreases the cross sectional area of head material to increase vibration transmitted upon the shaft upon ball impact.

Another golf club head design disclosed in U.S. Pat. No. 3,995,857 as taught by Cochran includes a golf club head having a high radius of gyration formed of steel and having tungsten embedded inserts added to the heel and toe areas of the club head itself. In U.S. Pat. No. 5,921,871, Fisher teaches a golf putter head design with interchangeable rebound control inserts which are readily interchangeable to provide higher or lower rebound factors depending upon the speed of the green.

Colucci, in U.S. Pat. No. 6,692,372 teaches a putter head which includes three long plastic insert sighting lines to assist a golfer in lining up the club head with the intended target. The patent to White, U.S. Pat. No. 5,335,913, teaches a golf club putter head having a removable blade forming a front striking surface in a fashion such that the blade may be adjustably positioned longitudinally with respect to the body of the putter head. Two protrusions are provided on the bottom surface which position the blade above the grass surface.

BRIEF SUMMARY OF THE INVENTION

This invention is directed to a golf club putter head including an elongated body formed of a first metal and having an upright front portion defining a ball striking face, enlarged heel and toe portions symmetrically shaped about a vertical central axis of said body, and a horizontal bottom portion defining outer portions of beveled bottom surfaces. The front and bottom portions have a thickness at each central portion thereof which is substantially less than a width and a height, respectively, of the heel and toe portions. A slanted elongated cavity having a longitudinal axis receives and secures a lower distal end of a golf club shaft. A sole plate formed of a second metal is secured within a mating slot formed into only a central portion of the bottom surface. A front edge of the sole plate also forms a lower central portion of the ball striking face while a bottom surface of the sole plate is continuous with the bottom surfaces of the body. A balance weight formed of a third metal denser than that of the first metal is positioned and secured into a mating cavity formed into the bottom surface of the heel portion to cause the putter head to be balanced about the longitudinal axis of the golf club shaft.

It is therefore an object of this invention to provide a uniquely configured golf putter head formed of multiple materials having different densities, hardnesses and wear factors to achieve desired results of balance and rigidity.

Another object of this invention is to provide a golf putter head having a greater portion of the club head mass positioned at the heel and toe of the golf club head.

Yet another object of this invention is to provide a golf putter head formed substantially of cast brass or bronze material and incorporating a sole plate formed of stainless steel having harder, more wear resistant characteristics disposed at the center part of the sole of the club head.

Still another object of this invention is to provide a golf putter head having greater mass distribution at the heel and toe of the club head and being balanced about an upwardly extending slanted longitudinal axis of the club handle when attached to the club head.

A further object of this invention is to provide a golf putter head having a planar striking face which includes a diamond scored or grooved pattern for greater ball striking consistency.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
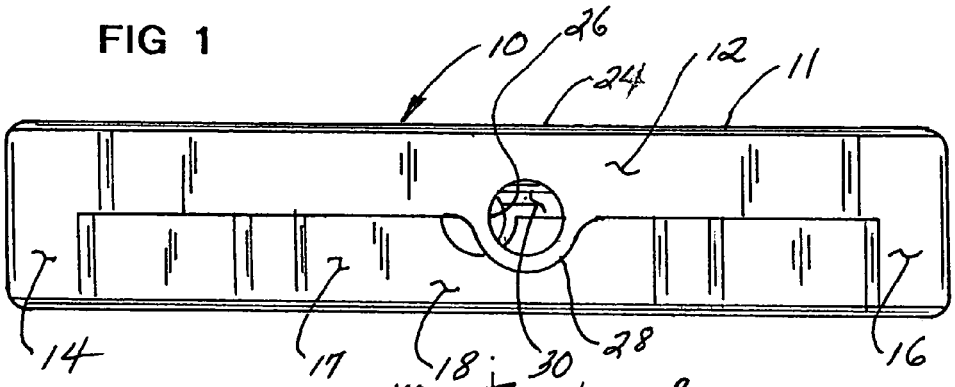
FIG. 1 is a top plan view of the golf putter head of the invention.

Referring now to the drawings, one embodiment of the invention is there shown generally at numeral 10 and includes an elongated body 11 formed of a first metal, preferably brass or bronze, in cast, homogenous form. The cast body 11 includes an upright front portion 12 defining a planar front ball striking face 24 and also having enlarged heel and toe portions, 16 and 14, respectively (the reverse being the case for a right-handed golfer). The body 11 further includes a horizontal bottom portion 18 defining the outer portions of beveled bottom surfaces 32*a* and 32*b* of a beveled bottom surface 32.

The upright front portion 12 and the central bottom portion 18 have thicknesses which are substantially less than the width and height, respectively, of the heel and toe portions 16 and 14, respectively. This arrangement provides sufficient stiffness in the central portion of the club head 10 while providing an increased weight distribution and inertia at the toe and heel portions.

Figure 2:
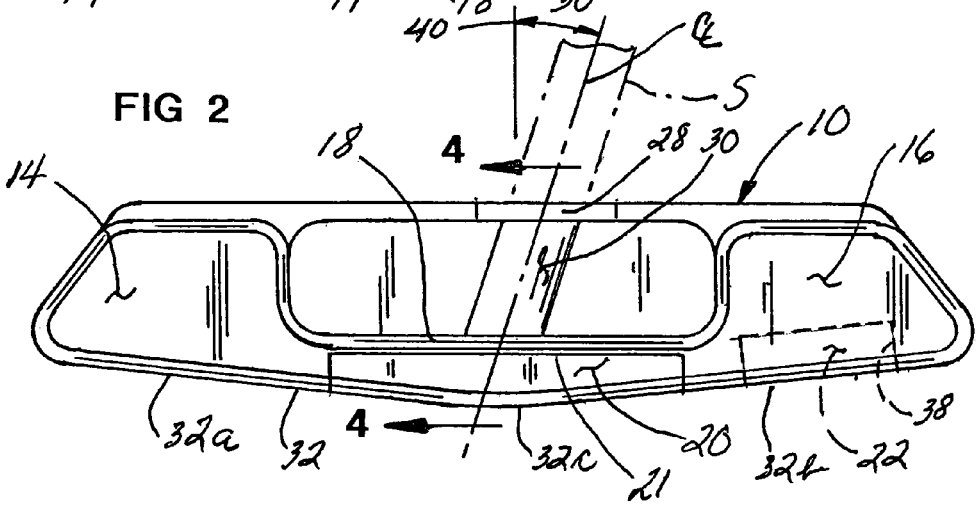
FIG. 2 is a rear elevation view of FIG. 1 showing a lower portion of the club handle in phantom.
Figure 3:
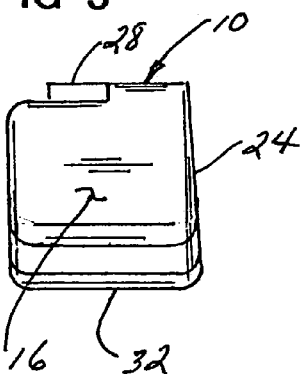
FIG. 3 is a right side elevation view of FIG. 2.

Positioned centrally with respect to the length and width of the club head 10 is a slanted, elongated cavity 30 and mating aligned upper aperture 28 oriented at an angle 40, preferably 18° with respect to vertical, along centerline CL of the golf club shaft S shown in phantom in FIG. 2. By this arrangement, the golf club shaft S may be inserted into the cavity 30 through upper aperture 28 and secured in place as shown, in part, in FIG. 4 by the securement of an internal tapered ferrel by an elongated threaded fastener passed downwardly through the hollow golf club shaft S into a threaded cavity 34.

Figure 4:
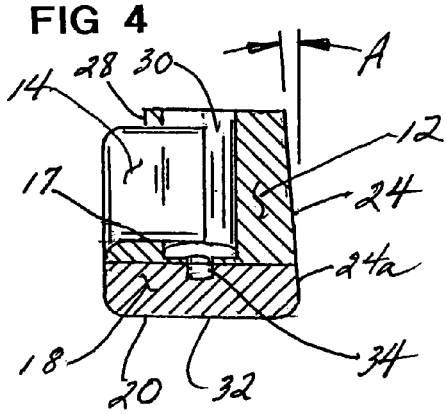
FIG. 4 is a section view in the direction of arrows 4—4 in FIG. 3.

A generally flat sole plate 20 formed of stainless steel is secured by suitable epoxy glue or silver solder into a tightly fitted mating cavity 21. The sole plate 20, formed of stainless steel, provides for greater wear resistance. Moreover, with its increased hardness over that of brass or bronze used to form the body 11, as best seen in FIG. 4, the front edge 24*a* thereof defines the lower central portion of the ball striking face 24 for heightened ball striking crispness and enhanced accuracy. Note that the ball striking surface 24 is oriented at an angle A, preferably 4°, with respect to vertical in a tipped back fashion to add a very slight loft or lifting force when the golf ball is struck during each putting stroke.

Figure 5:
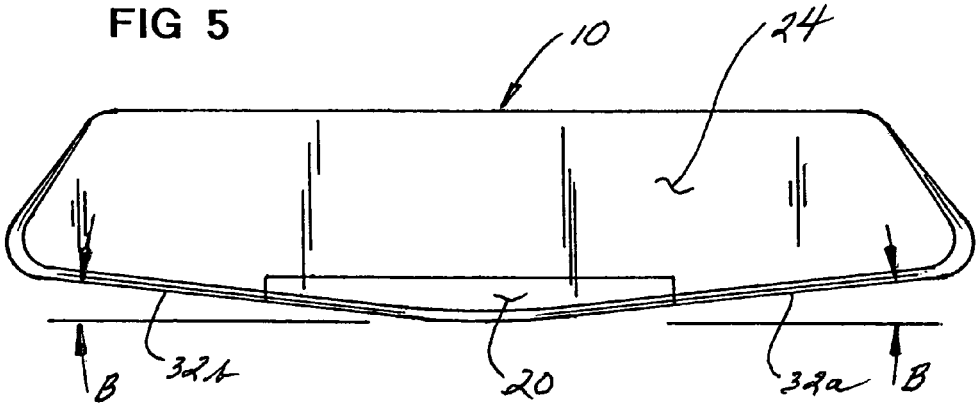
FIG. 5 is a front elevation view of one embodiment showing a plain striking face of this embodiment.

Again, the horizontal bottom portion 18 is thinned substantially down to surface 17 so as to minimize the weight of the putter head 10 in the central portion thereof. Each of the heel and toe portions, 16 and 14, respectively, cooperatively define beveled bottom surfaces 32*b* and 32*a*, respectively, while the central portion of the beveled bottom surface 32 is defined by the bottom surface 32*c* of the sole plate 20. The preferred angle of bevel, angle B in FIG. 5, is in the range of about 6°, for a total angular bevel between surface 32*b* and 32*a* of 12°. Note that the center junction of the two bevel central portion 34*a* is radiused at about a 6° radius.

It should be clearly understood at this point that the sole plate 20, formed of harder and greater wear resistant stainless steel, serves multiple functions to enhance performance of the golf putter head 10. First, the wear resisting characteristic of the bottom surface 32*c* is greatly enhanced over that of the brass body 11 forming the beveled surface outer portions 32*a* and 32*b*. Moreover, because the lower central portion of the ball striking face 24 at 24*a* in FIG. 4 is defined by one flat edge of the sole plate 20, a crisper more defined striking characteristic against a golf ball is achieved during putting.

Figure 6:
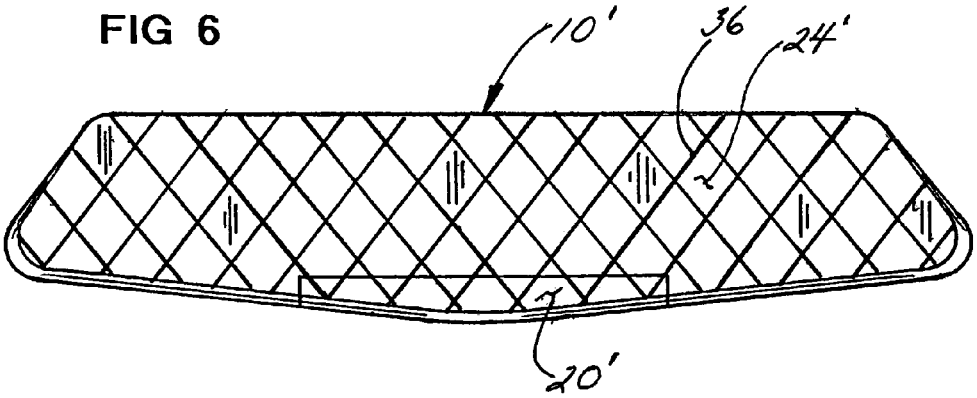
FIG. 6 is a front elevation view of an alternate embodiment of the striking face showing a diamond-scored face.

Two alternate embodiments of the golf ball striking face 24 and 24' are shown in FIGS. 5 and 6. In FIG. 5, the ball striking face 24 is shown as being substantially smooth, flat and uninterrupted. However, in FIG. 6, the same flat smooth uninterrupted surface 24' has been scored as shown typically at 36 with a diamond pattern over the entire golf ball striking surface 24'. These diamond oriented scores 36 are spaced apart approximately 0.3", having a minimal depth of about 0.02" to 0.4" and a width of approximately 0.1". By this diamond scored texturing surface 24', the contact with the golf ball during a putting stroke is enhanced to more accurately impose the desired directional control and loft into the golf ball when struck.

Figure 7:
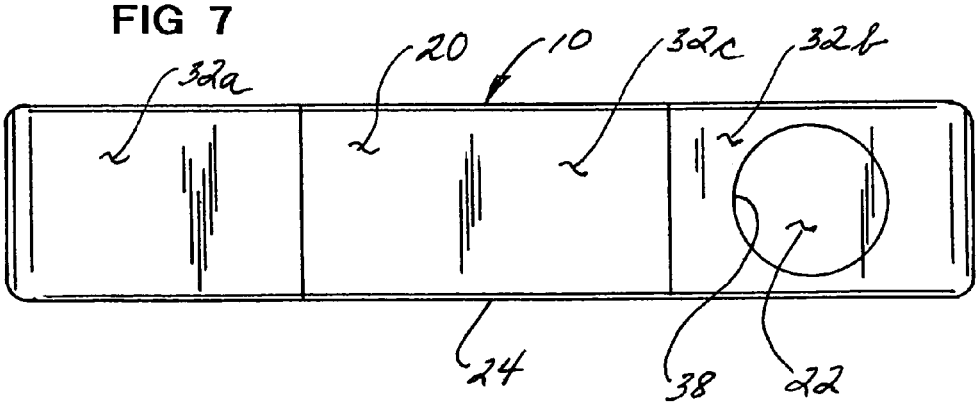
FIG. 7 is a bottom plan view of the invention.

Referring lastly to FIGS. 2 and 7, the preferred embodiment of the invention is in balanced form about the centerline CL of the golf club shaft S shown in phantom in FIG. 2. Because the club head 10 is substantially symmetric in overall configuration, the angular orientation of the centerline CL at 18° with respect to vertical causes a club head 10 unbalance about centerline CL. To effect a perfect balance of the club head 10, a suitably sized metal plug 22 is provided fitted into a cavity 38 and adhered using an epoxy glue or silver solder into the brass which comprises the body 11 itself. The preferred metal for this balance plug 22 is an Elkonite product formed of alloys and containing tungsten for increased density. The product is available in bar form under part number 10W3 from Elkon Works, Inc. of New Jersey. The preferred size has a diameter of ¾" and a length of 7/16". When placed as shown with respect to the centerline CL, very precise club head balance is achieved.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A golf club putter head comprising:

an elongated body formed of a first metal and having an upright front portion defining a planar ball striking face, enlarged heel and toe portions symmetrically shaped about a vertical central axis of said body, and a horizontal bottom portion defining outer portions of beveled bottom surfaces of said body;

said front portion and said bottom portion having thicknesses at each central portion thereof which are substantially less than a width and a height, respectively, of said heel and toe portions;

a slanted elongated cavity having a longitudinal axis for receiving and securing a lower distal end of a golf club shaft therein;

a generally flat sole plate formed of a second metal secured within a mating slot formed into only a central portion of said bottom surfaces, one edge of said sole plate continuous with and forming a lower central portion of said ball striking face, a bottom surface of said sole plate being continuous with and forming a central portion of said bottom surfaces of said body;

a balance weight formed of a third metal having a density substantially greater than that of said first metal and positioned and secured into a mating cavity formed into the bottom surface of said heel portion, said balance weight sized to cause said putter head to be balanced about the longitudinal axis passing centrally through the golf club shaft and said cavity.

2. A golf club putter head as set forth in claim 1, wherein:

said ball striking face is scored in a diamond pattern for enhanced golf ball striking consistency.

3. A golf club putter head as set forth in claim 1, wherein:

said first material is brass or bronze;

said second material is stainless steel having a density, hardness and wear resistance greater than that of said first material, said third material includes tungsten having a density greater than that of said first material.

4. A golf club putter head as set forth in claim 1, wherein:

said sole plate is adhesively attached in said slot.

5. A golf club putter head as set forth in claim 1, wherein:

said ball striking face lies in a plane slanted at about 4° to the longitudinal axis.

6. A golf club putter head as set forth in claim 1, wherein;

said beveled bottom surfaces are each oriented at an angle of about 6° to horizontal.

7. A golf club putter head comprising:

an elongated body formed of a first metal and having an upright front portion defining a planar ball striking face, enlarged heel and toe portions symmetrically shaped about a vertical central axis of said body, and a horizontal bottom portion defining outer portions of beveled bottom surfaces of said body;

said front portion and said bottom portion having thicknesses at each central portion thereof which are substantially less than a width and a height, respectively, of said heel and toe portions;

a slanted elongated cavity having a longitudinal axis for receiving and securing a lower distal end of a golf club shaft therein;

a sole plate formed of a second metal secured within a mating slot formed into only a central portion of said bottom surface, a front edge of said sole plate also forming a lower central portion of said ball striking face, a bottom surface of said sole plate being continuous with the bottom surfaces of said body.

8. A golf club putter head as set forth in claim 7, wherein:

said ball striking face is scored in a diamond pattern for enhanced golf ball striking consistency.

9. A golf club putter head as set forth in claim 7, wherein:

said sole plate is adhesively attached in said slot.

10. A golf club putter head as set forth in claim 7, wherein:

said ball striking face lies in a plane slanted at about 40 to the longitudinal axis.

11. A golf club putter head as set forth in claim 7, wherein:

said beveled bottom surfaces are each at an angle of about 6° to horizontal.

* * * * *